US006520470B1

(12) United States Patent
Chan

(10) Patent No.: US 6,520,470 B1
(45) Date of Patent: Feb. 18, 2003

(54) RETAINING MECHANISM

(75) Inventor: Chik Sum Chan, Hong Kong (HK)

(73) Assignee: Kado Industrial Company Limited, Shatin (HK)

( * ) Notice: Subject to any disclaimer, the term of this patent is extended or adjusted under 35 U.S.C. 154(b) by 0 days.

(21) Appl. No.: 09/429,567

(22) Filed: Oct. 28, 1999

(30) Foreign Application Priority Data

Oct. 28, 1998 (GB) ..... 9823650

(51) Int. Cl.[7] ..... A47B 91/00

(52) U.S. Cl. ..... 248/346.04; 248/310; 215/376; 222/173; 222/153.01

(58) Field of Search ..... 215/2, 376, 377; 248/346.03, 310, 154, 346.04, 346.07, 551; 222/173, 153.01, 153.02, 153.03, 153.09

(56) References Cited

U.S. PATENT DOCUMENTS

| | | | | |
|---|---|---|---|---|
| 1,056,217 | A | * | 3/1913 | Roth et al. |
| 2,099,635 | A | * | 11/1937 | Toniolo |
| 2,731,273 | A | | 1/1956 | Edens |
| 2,837,245 | A | | 6/1958 | Grebowiec |
| 3,124,264 | A | * | 3/1964 | Waisberg |
| 3,155,281 | A | * | 11/1964 | Stracey |
| 3,278,086 | A | | 10/1966 | Clouzeau |
| 3,747,946 | A | * | 7/1973 | Edens |
| 3,926,532 | A | | 12/1975 | Schlenker |
| 4,044,836 | A | * | 8/1977 | Martin et al. |
| 4,392,759 | A | | 7/1983 | Cook |
| 4,509,654 | A | | 4/1985 | Maguire |
| 4,563,116 | A | * | 1/1986 | Edens |
| 4,687,367 | A | * | 8/1987 | Bondioli |
| 4,915,239 | A | | 4/1990 | Persch |
| 5,148,948 | A | | 9/1992 | Granville et al. |
| 5,167,405 | A | * | 12/1992 | Cayley, Jr. |
| 5,269,428 | A | * | 12/1993 | Gilbert |
| 5,295,598 | A | * | 3/1994 | Gerlach et al. |
| 6,142,325 | A | * | 11/2000 | Chomik |

FOREIGN PATENT DOCUMENTS

| | | |
|---|---|---|
| EP | 0 427 514 A1 | 5/1991 |
| FR | 407288 | 2/1910 |
| GB | 238634 | 7/1925 |
| GB | 332556 | 7/1930 |
| GB | 818618 | 7/1959 |
| GB | 1014512 | 12/1965 |
| GB | 1024406 | 3/1966 |
| GB | 2151493 A | 7/1985 |
| GB | 2285790 | 7/1995 |
| JP | 08 268 409 | 10/1996 |
| WO | WO 95/03977 | 2/1995 |

OTHER PUBLICATIONS

European Search Report No. EP 99 30 6760, dated Jan. 13, 2000.

Great Britain Search Report No. GB 9908937.7 dated Aug. 3, 1999.

* cited by examiner

*Primary Examiner*—Korie Chan
(74) *Attorney, Agent, or Firm*—Hall, Priddy, Myers & Vande Sande

(57) ABSTRACT

A mechanism for releasably retaining an article, e.g. a liquid dispenser, with a base portion is disclosed, in which the dispenser includes a protrusion releasably engageable with the base portion, and the base portion includes locking means adapted to prevent disengagement of the dispenser from the base portion, and the locking means includes a ring which is movable, e.g. by rotation or swiveling action, relative to the base portion to lock or unlock the dispenser from said base portion.

18 Claims, 11 Drawing Sheets

RETAINING MECHANISM

BACKGROUND OF THE INVENTION

This invention relates to a retaining mechanism and, in particular, such a mechanism suitable for, but not limited to, retaining an article (e.g. a liquid dispenser) with a base member.

Various retaining mechanisms have been devised for releasably engaging an article to a base, e.g. for the releasable engagement of a liquid dispenser with a base member. For the purpose of discouraging unauthorized removal of the liquid dispenser from the place of use, the dispenser is usually provided with a protrusion with a spherical end, which does not allow the dispenser to support itself on an ordinary support surface, e.g. a sink counter top. However, it is found that after a certain period of use, the dispenser may get loosed from the base member, so that it is necessary to fit the dispenser again into the base member. It is therefore an object of the present invention to provide a retaining mechanism in which the aforesaid shortcoming is mitigated, or at least to provide a useful alternative to the public.

It should be pointed out that although a liquid dispenser is here shown as an embodiment of the present invention, it should be understood that the present invention can find its application in, e.g. the releasable engagement and locking of any other utensil, e.g. a pair of pliers or a pair of scissors, to a base member.

SUMMARY OF THE INVENTION

According to a first aspect of the present invention, there is provided a retaining member for releasably retaining an article, wherein said retaining member includes at least one engagement member, at least one locking mechanism, and at least one body member having a central longitudinal axis, wherein said at least one engagement member is movable radially relative to said central longitudinal axis of said body member between an engaged position and a disengaged position, wherein said at least one engagement member, when in said engaged position, is closer to said central longitudinal of said body member than when at said disengaged position, wherein said locking mechanism includes at least one ring member, wherein said ring member is movable relative to said body member in a first direction to a locking position to lock said article against disengagement from said retaining member, and wherein said ring member is movable relative to said body member in a second direction to a unlocked position to unlock said article, and wherein, when said engagement member is in said inner position and said ring member is in said unlocked position, said article is engageable with and disengageble from said retaining member.

According to a second aspect of the present invention, there is provided a container with a body member and a protrusion extending from said body member, wherein said protrusion includes at least two grooves on its outer surface.

BRIEF DESCRIPTION OF THE DRAWINGS

Embodiments of the present invention will be described by way of examples only, and with reference to the accompanying drawings, in which.

DETAILED DESCRIPTION OF THE PREFERRED EMBODIMENTS

Figure 1:
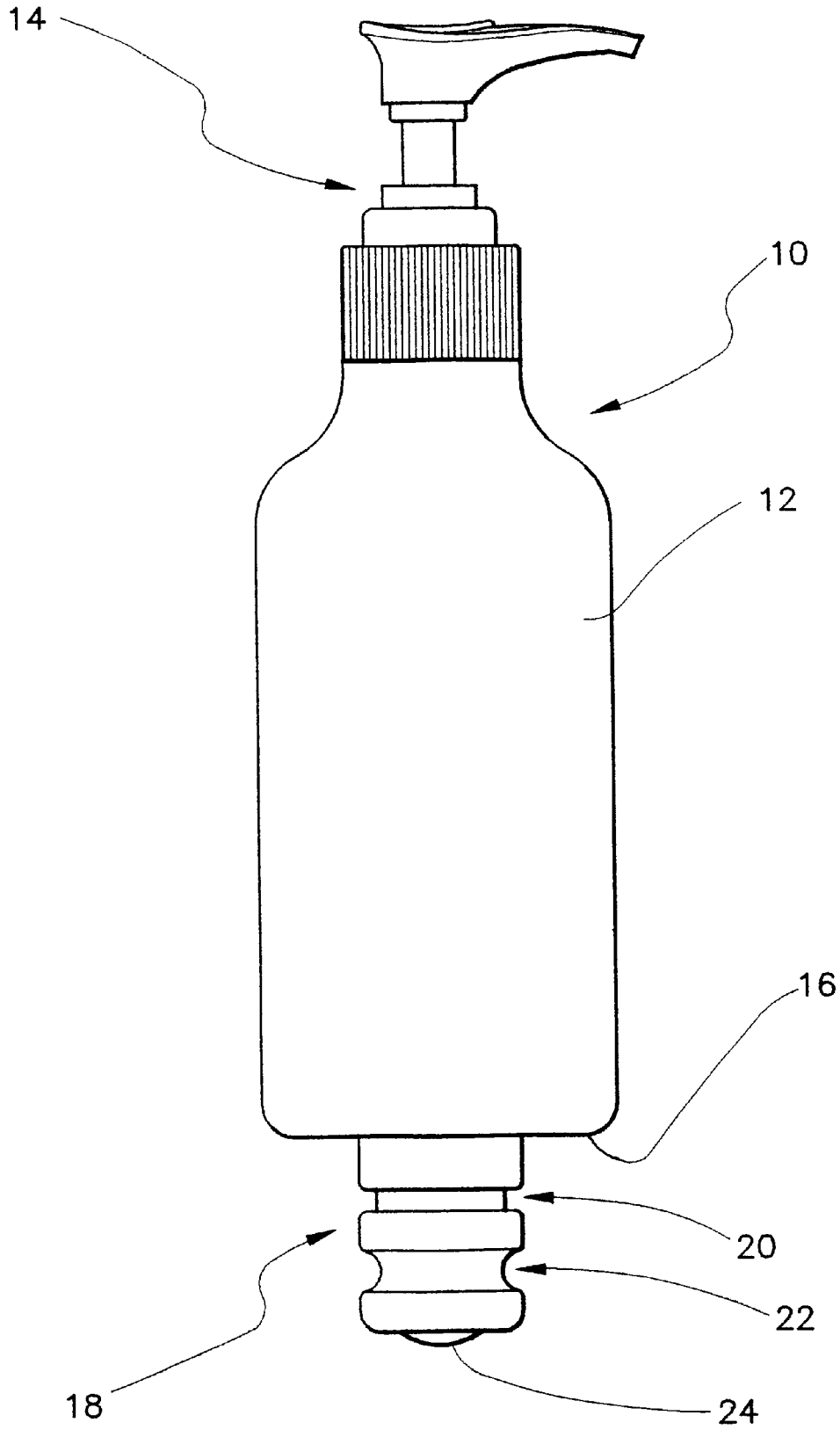
FIG. 1 shows a side view of a liquid dispenser with a protrusion forming part of the present invention.

Referring to FIG. 1, a liquid dispenser, e.g. for dispensing liquid soap, constituting an article of the present invention is shown and generally designated as 10. The dispenser 10 includes a body 12 for containing the liquid, with a conventional manually actuated pump and spout assembly 14 threaded to the upper end of the body 12. Formed at and extending from a lower end 16 of the body 12 is a protrusion 18. As can be seen in FIG. 1, the protrusion 18 is generally cylindrical in shape with two groove portions 20, 22 on its outer surface 23. It can be seen that the while the surface of the groove portion 20 is substantially planar, the surface of the groove portion 22 is generally concave. At the distal end of the protrusion 18 is a part-spherical portion 24. It can be seen that, with such an arrangement, the dispenser 10 cannot self-support itself on an ordinary support surface, e.g. a desk top or sink counter top.

Figure 2:
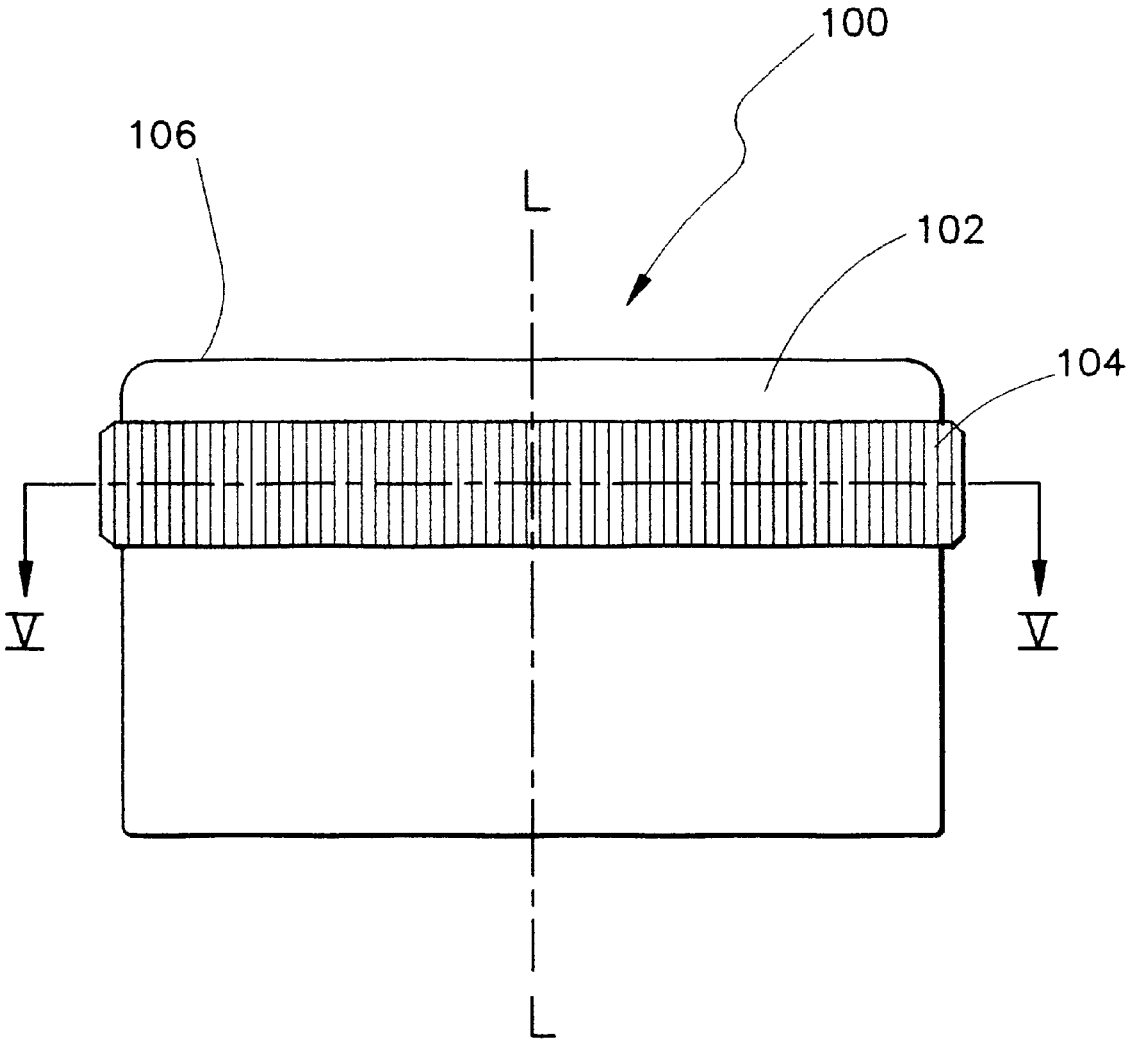
FIG. 2 shows a side view of a first embodiment of a base portion forming part of the present invention.
Figure 3:
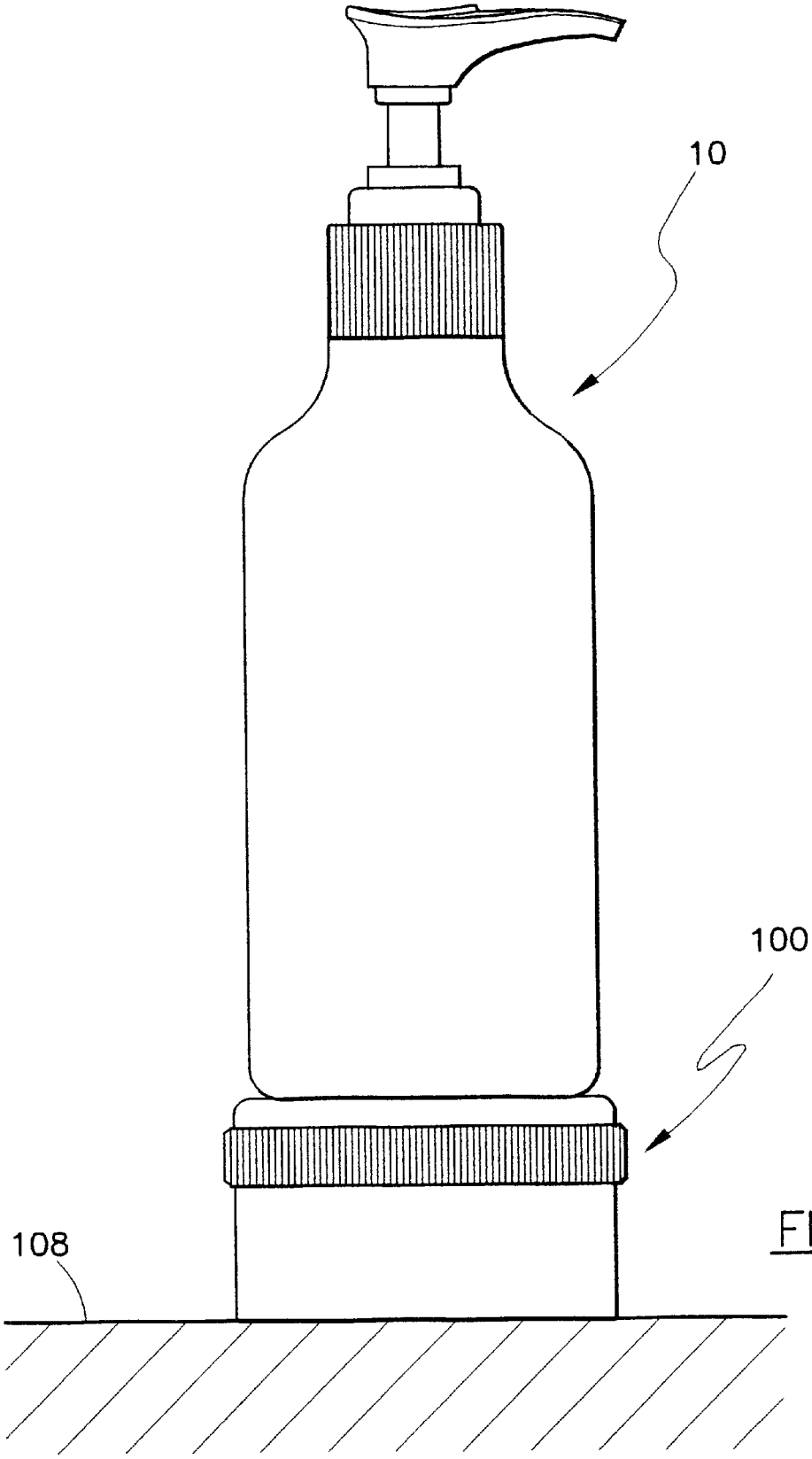
FIG. 3 shows the liquid dispenser shown in FIG. 1 engaged with the base portion shown in FIG. 2, and attached as a whole to a support surface.

Shown in FIG. 2 is a first embodiment of a base portion according to the present invention, and generally designated as 100. The base portion 100 includes a body portion 102 and a ring 104, which is rotatable or swivelable relative to the body portion 102 about a common central longitudinal axis L—L. The outer surface of the ring 104 is corrugated to enhance gripping by a hand of a user for rotation/swiveling. The body portion 102 is open on its upper end 106, through which the protrusion 18 of the dispenser 10 can enter and be received within an internal cavity of the body portion 102. As shown in FIG. 3, the dispenser 10 may thus be engaged with the base portion 100, so that the dispenser 10 can be supported upright on a support surface 108. At the bottom end of the base portion 100 may be provided an adhesive tape, or some other adhesive material, which serves to secure the base portion 100 to the support surface 108.

Figure 4:
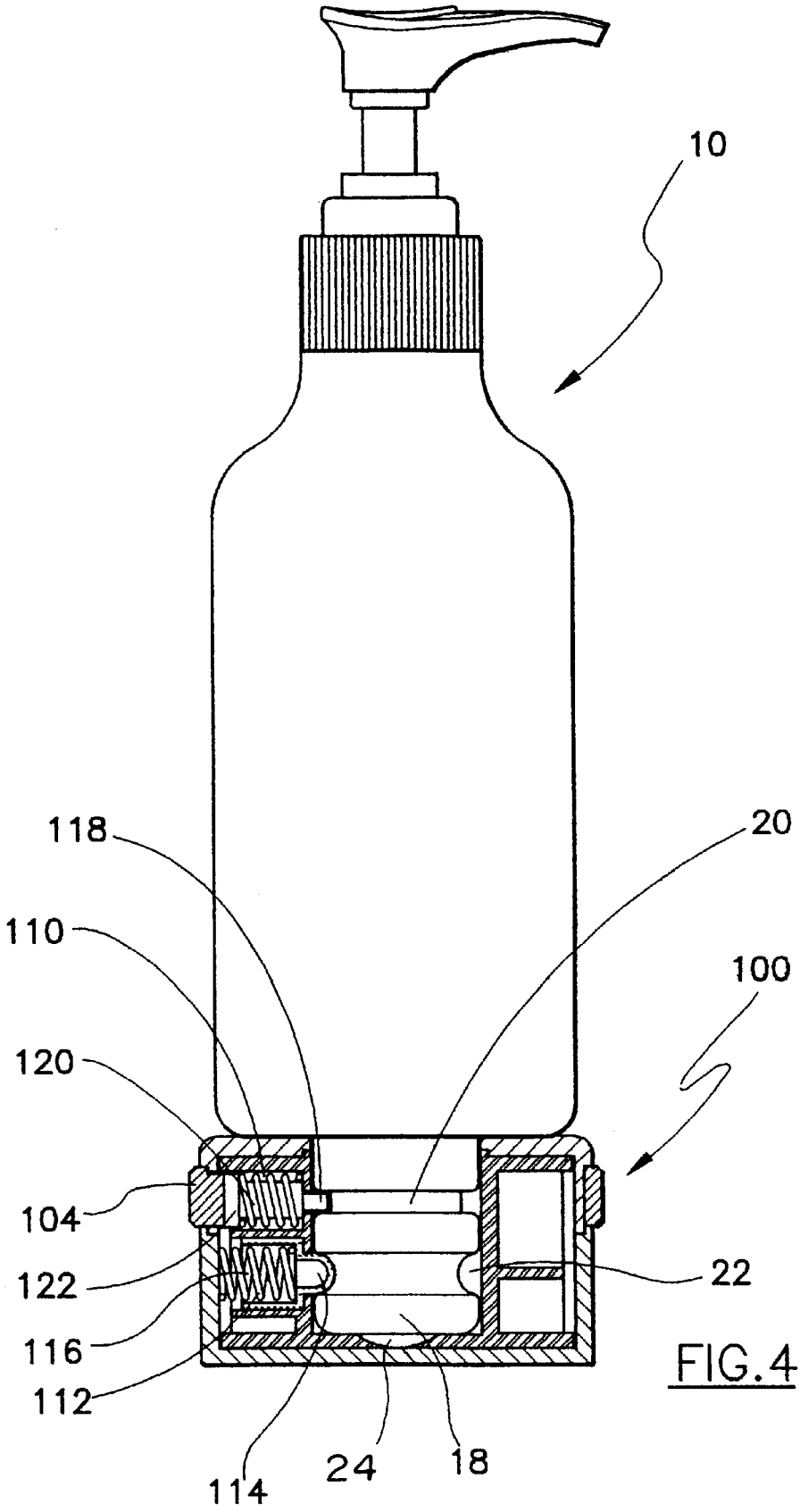
FIG. 4 is a part sectional view of the liquid dispenser and base portion shown in FIG. 3 in which the liquid dispenser is locked with the base member.

FIG. 4 shows in more detail the mode of engagement between the dispenser 10 and the base portion 100. As can be seen, the protrusion 18 of the dispenser 10 is received within an internal cavity of the base portion 100. The part-spherical portion 24 of the protrusion 18 sits on a substantially correspondingly shaped and sized concave trough on the inner bottom end of the base portion 100.

As shown in FIG. 4, there is a set of upper pin assemblies 110 (of which only one is shown in FIG. 4) and a set of lower pin assemblies 112 (of which, again, only one is shown in FIG. 4). In this particular embodiment, there are three upper assemblies 110, and three lower pin assemblies 112. Referring first to the set of lower pin assemblies 112, each such assembly 112 includes a lower pin 114 and a lower spring 116, which biases the respective lower pin 114 radially towards the inner cavity of the base portion 100. Such an arrangement ensures that when the dispenser 10 is engaged with the base portion 100 in the position as shown in FIG. 4, the lower pins 114 are engaged and snap-fitted with the groove portion 22, so that the dispenser 10 is releasably engaged with the base portion 100. If the dispenser 10 is not locked with the base portion 100 (in a manner to be discussed below), the dispenser 10 may be disengaged from the base portion 100 by being pulled upward and away from the base portion 100. In this way, the lower pin 114 will be pushed radially outward against the biasing force of the lower spring 116, thus allowing the dispenser 10 to be disengaged from the base portion 100.

As to the upper pin assemblies 110, each such assembly 110 includes an upper pin 118, an upper spring 120, and a head portion 122 integrally formed with the upper pin 118. In a manner to be discussed below, the upper pin 118 may be moved radially inwardly, and against the biasing force of the upper spring 120, to the position as shown in FIG. 4, to engage the groove portion 20. In this inner position, due to the shape of the upper pin 118 and the surface of the groove portion 20, the dispenser 10 is locked, i.e. prevented from being disengaged from the base portion 100, even if the dispenser 10 is pulled upward and away from the base portion 100.

Figure 5A:
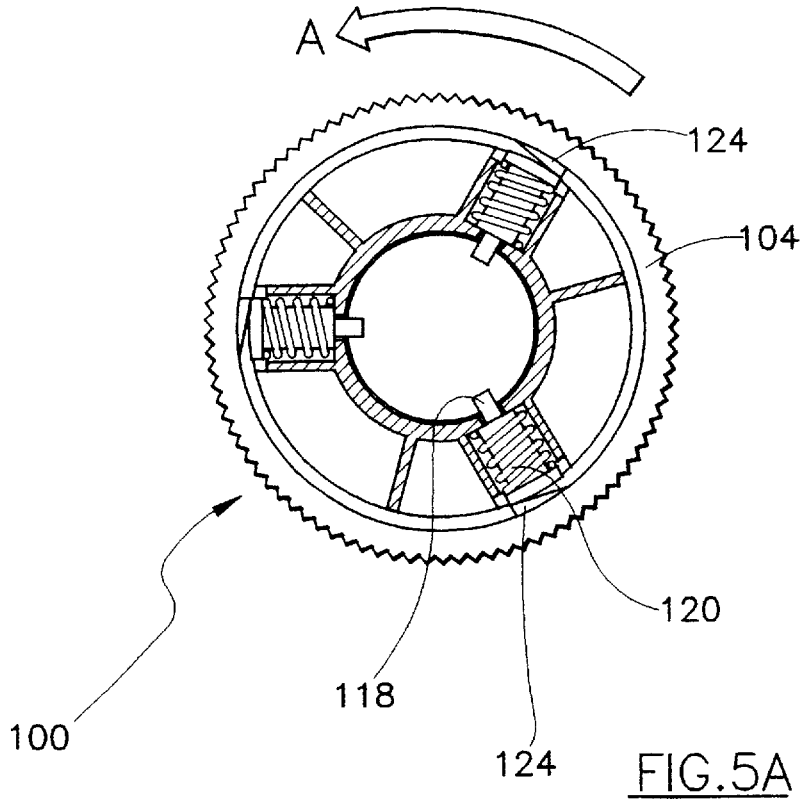
FIG. 5A is a sectional view of the base portion taken along the line V—V of FIG. 2 in which the locking pins are in the locking position.
Figure 5B:
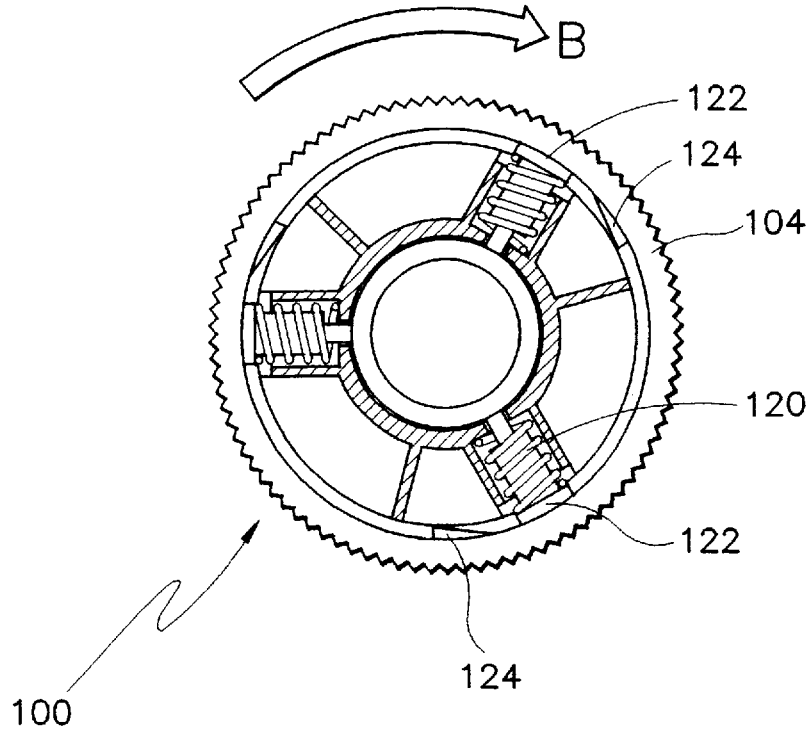
FIG. 5B is a sectional view of the base portion taken along the line V—V of FIG. 2 in which the locking pins are in the unlocked position.

FIG. 5A shows the upper pins 118 in the inner locking position. In this position, each of the head portion 122 of the pin 118 is actuated by a cam surface 124 on the inner surface of the ring 104, which cam surface 124 pushes and retains the upper pin 118 in its inner position to engage with the groove portion 20. When the ring 104 is rotated in the direction shown by the arrow A relative to the rest of the base portion 100, the cam surfaces 124 will come out of engagement with the respective head portion 122. As the upper springs 120 bias the respective upper pin 118 radially away from the longitudinal axis L—L of the base portion 100, to its outer position (as shown in FIG. 5B), the upper pins 118 will be disengaged from the groove portion 20 to unlock the dispenser 10, thus allowing the dispenser 10 to be disengaged from the base portion 100. The ring 104 may be turned/rotated in the direction shown by the arrow B to again lock the dispenser 10 to the base portion 100. It can be seen that the present invention provides a simple yet effective locking feature which can be used in a large variety of applications.

Figure 6:
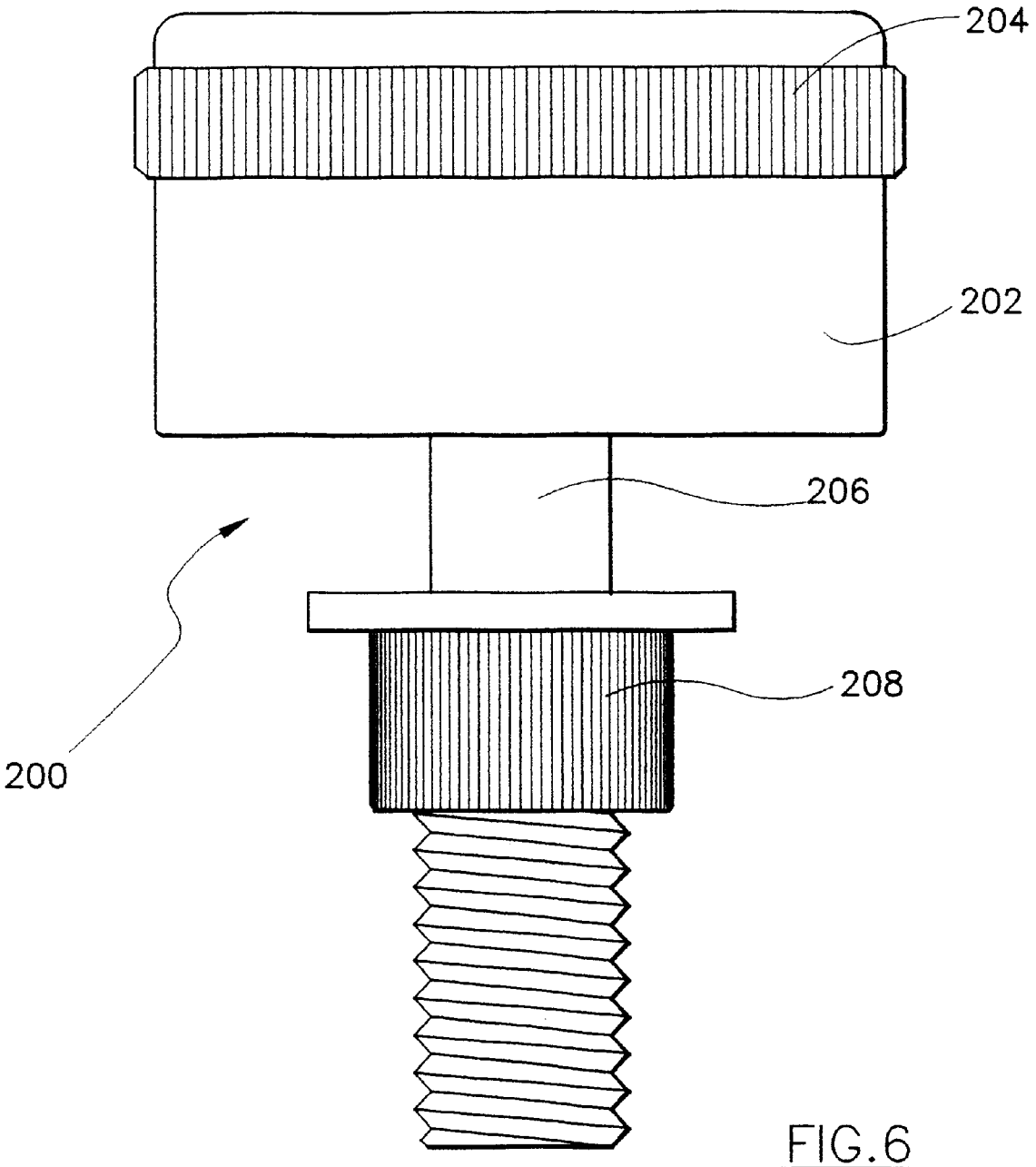
FIG. 6 is a side view of a second embodiment of a base portion, forming part of the present invention.

FIG. 6 shows a second embodiment of a base portion generally designated as 200. As in the first embodiment of base portion 100 discussed above, this base portion 200 also includes a body portion 202 and a ring 204. The main difference in this base portion 200 is that a shaft 206 extends from its bottom end. The distal end of the shaft 206 is threaded so that it can be threadedly engaged with a nut 208.

Figure 7:
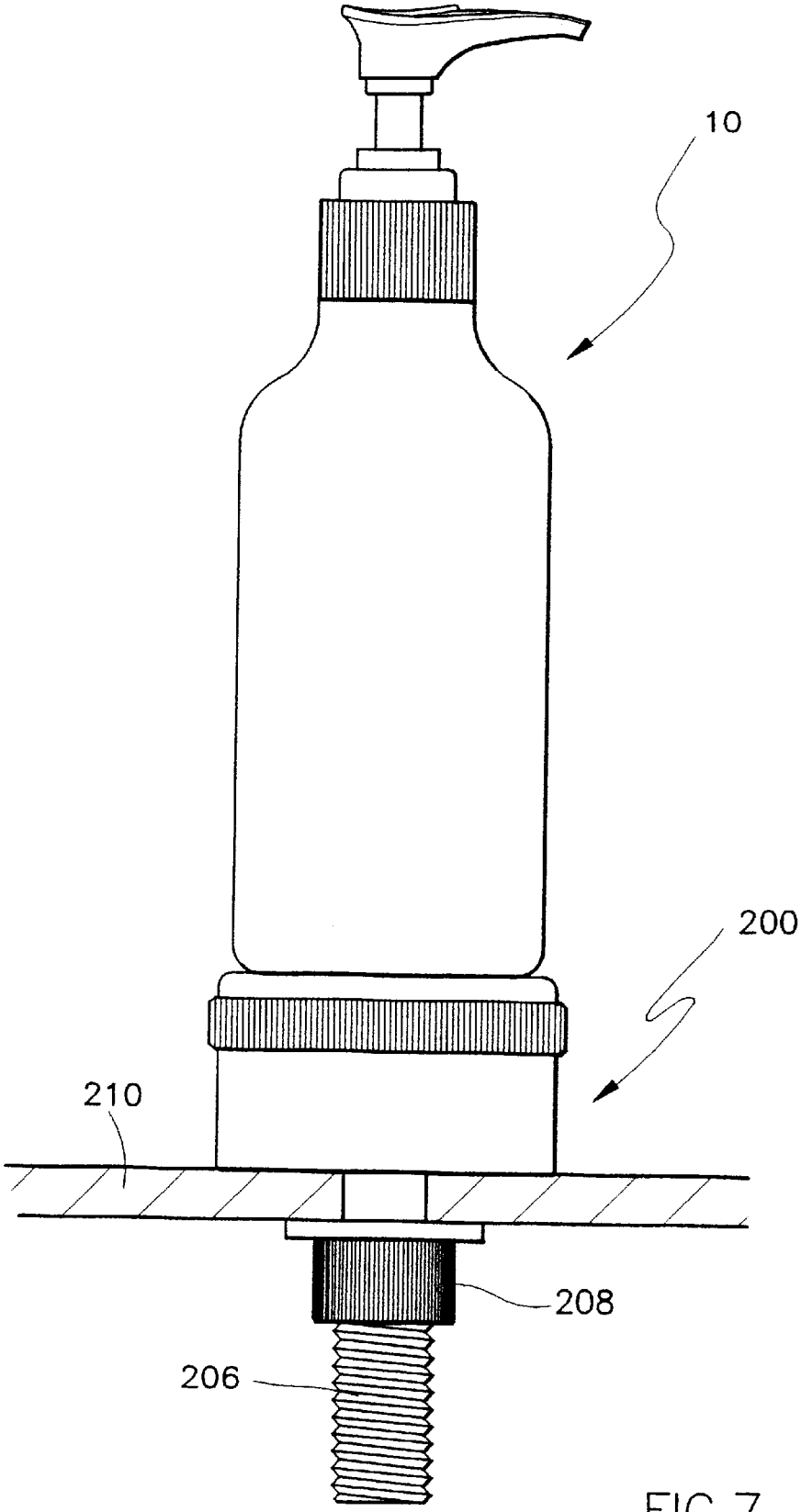
FIG. 7 is a side view showing the liquid dispenser shown in FIG. 1 engaged with the base portion shown in FIG. 6, and attached as a whole to a support surface.
Figure 8:
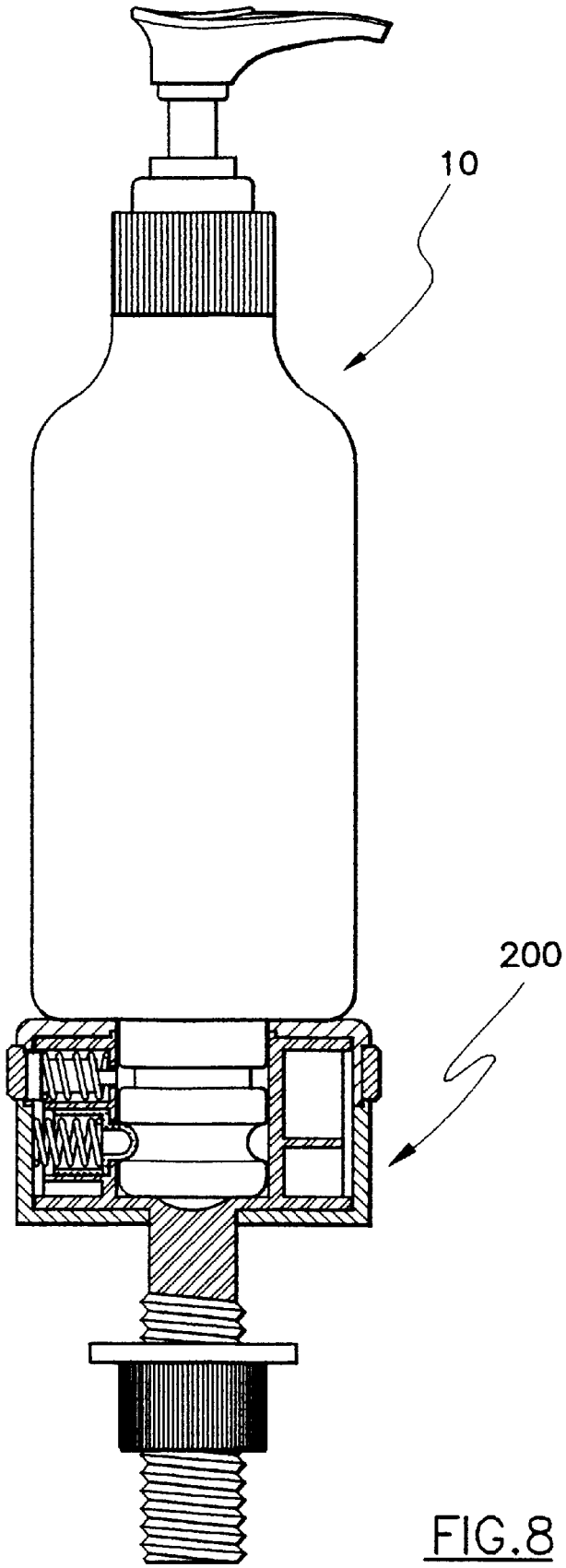
FIG. 8 is a part sectional view of the liquid dispenser and base portion shown in FIG. 7 in which the dispenser is not locked with the base portion.
Figure 9:
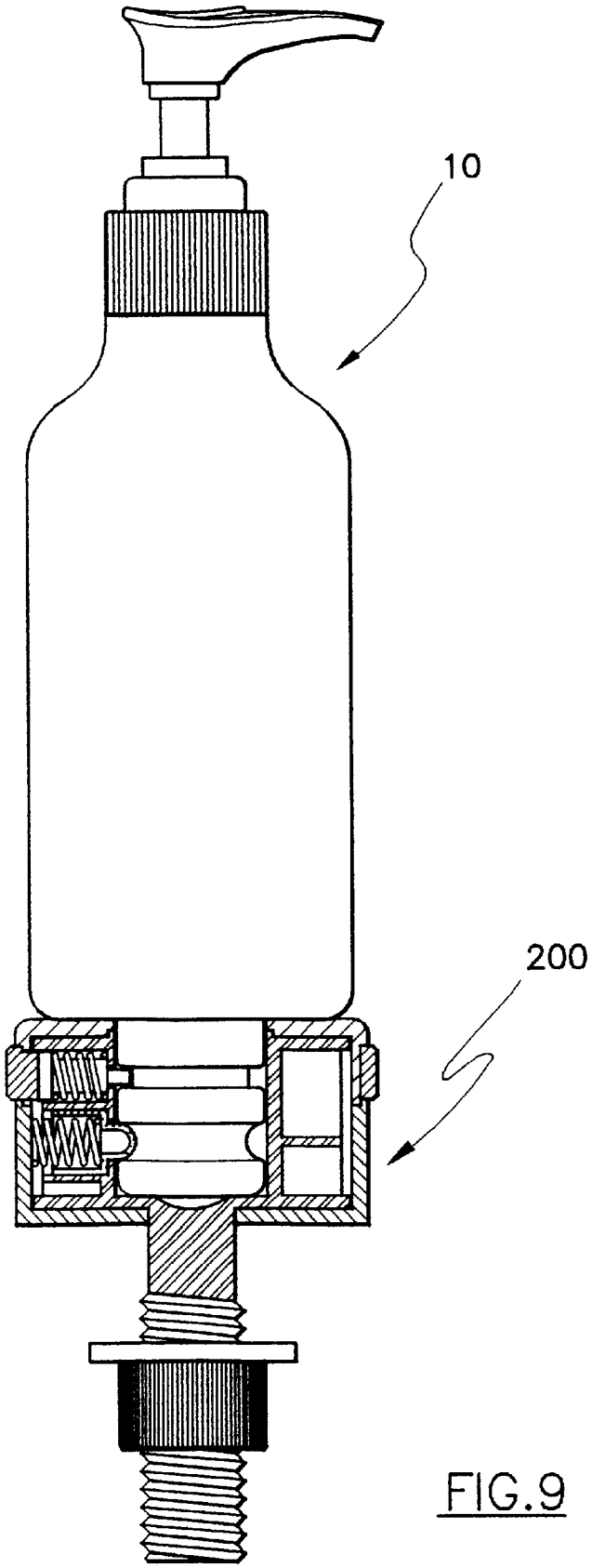
FIG. 9 is a part sectional view of the liquid dispenser and base portion shown in FIG. 7 in which the dispenser is locked with the base portion.

As shown in FIG. 7, the shaft 206 may be received through a bore hole of a support surface 210, and the nut 208 secured against the bottom side of the support surface 210, so as to secure the dispenser 10 and the base portion 200 to the support surface 210. FIGS. 8 and 9 show the mode of engagement of the dispenser 10 with the base portion 200 in, respectively, the unlocked and locked configuration. It can be seen that the mode of engagement and locking are the same as in the first embodiment discussed above.

Figure 10:
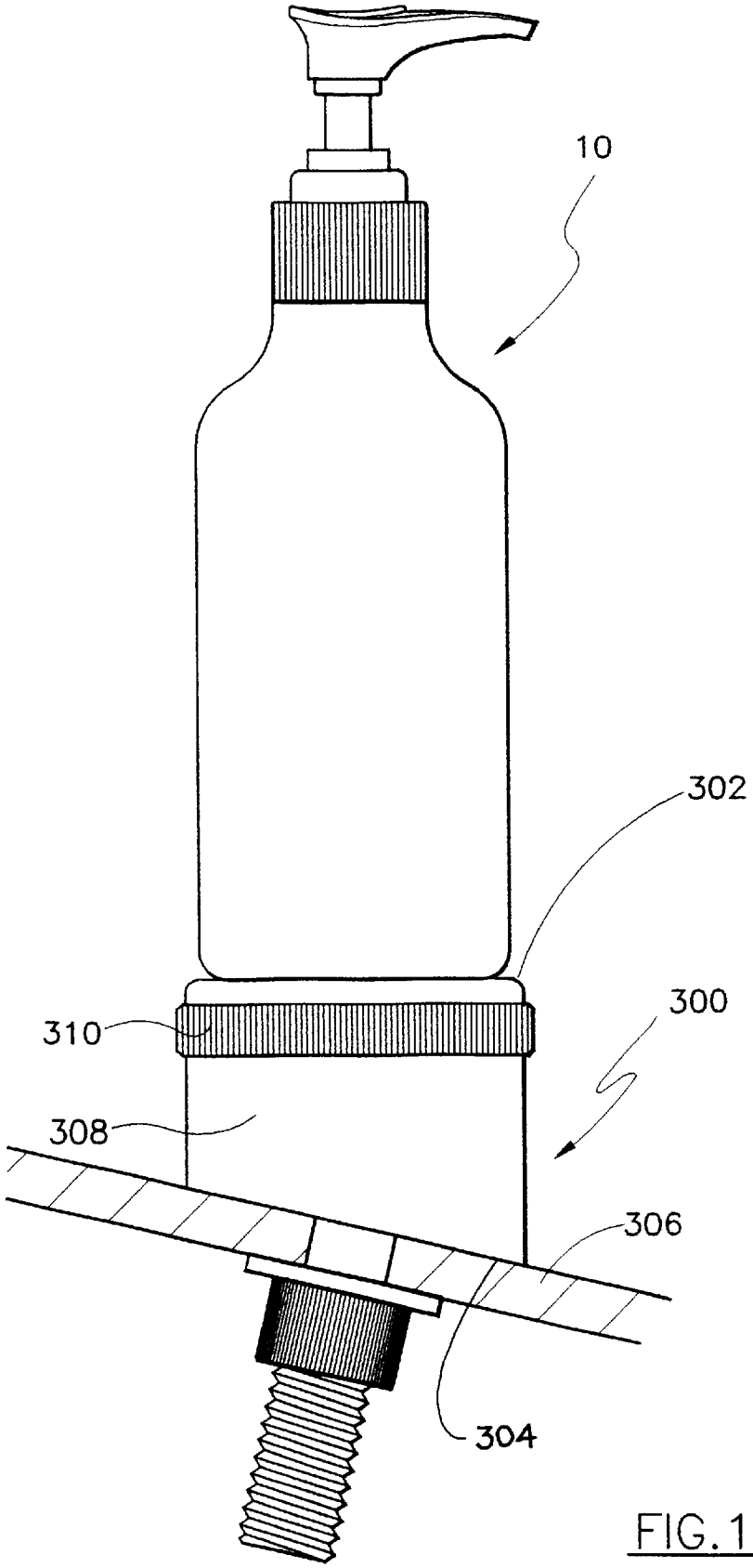
FIG. 10 is a side view showing the liquid dispenser shown in FIG. 1 engaged with a third embodiment of a base portion (forming part of the present invention), and attached as a whole to a support surface.
Figure 11:
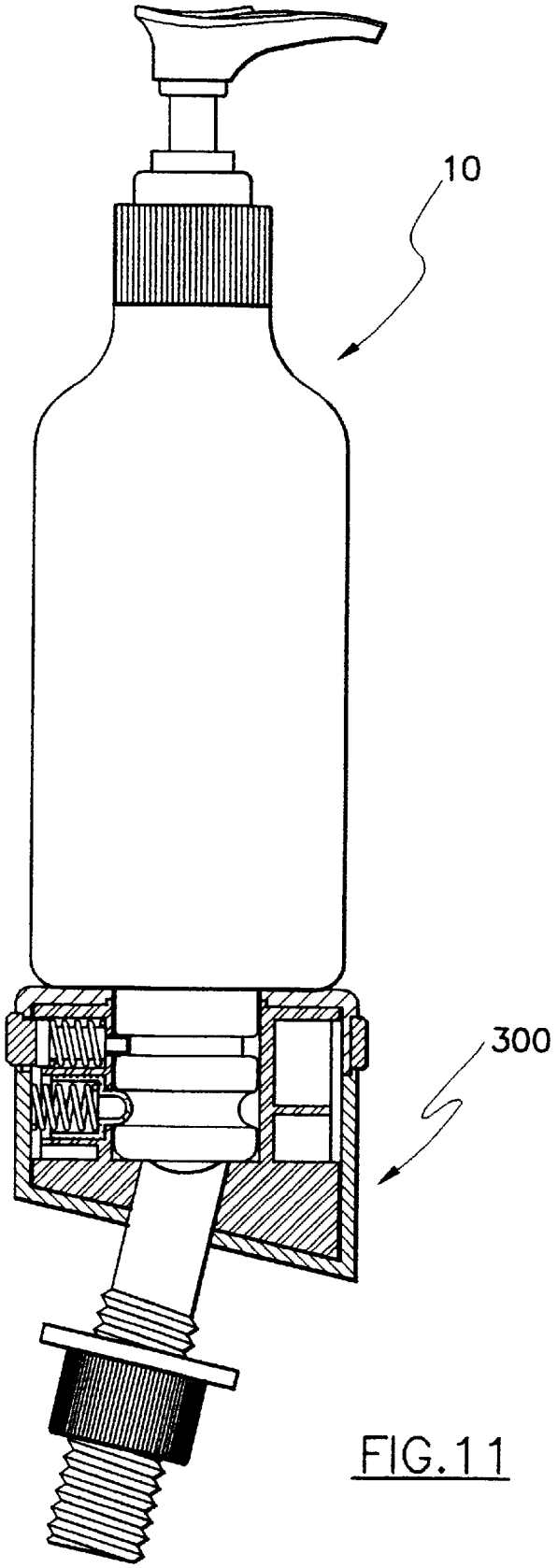
FIG. 11 is a part sectional view of the liquid dispenser and base portion shown in FIG. 10 in which the liquid dispenser is locked with the base portion.

FIGS. 10 and 11 show a third embodiment of a base portion 300 engaged with the dispenser 10, which base portion 300 includes a body portion 308 and a ring 310. The main difference between this base portion 300 and the base portion 200 is that, in this base portion 300, the upper surface 302 and the lower surface 304 are non-parallel, i.e. they are inclined to each other. As shown in these two figures, the dispenser 10 can still assume an upright position although it is secured to a slanted support surface 306. Alternatively, the dispenser 10 may assume an appropriately slanted position when it is secured to a horizontal support surface. It can be seen in FIG. 11 that the mode of engagement and locking are the same as in the first and second embodiments discussed above.

It should be understood that the above only describe examples of how the present invention may be carried out, and that various modifications and/or alterations may be made thereto without departing from the spirit of the invention hereof.

What is claimed is:

1. A retaining member for releasably retaining an article, wherein said retaining member includes at least one engagement member, at least one locking mechanism, and at least one body member having a central longitudinal axis, wherein said at least one engagement member is movable radially relative to said central longitudinal axis of said body member between an engaged position and a disengaged position, wherein said at least one engagement member, when in said engaged position, is closer to said central longitudinal axis of said body member than when at said disengaged position, wherein said locking mechanism includes at least one ring member, wherein said ring member is movable relative to said body member in a first direction to a locking position to lock said article against disengagement from said retaining member, and wherein said ring member is movable relative to said body member in a second direction to an unlocked position to unlock said article, and wherein, when said engagement member is in said engaged position and said ring member is in said unlocked position, said article is engageable with and disengageble from said retaining member.

2. A retaining member according to claim 1 wherein said first direction is substantially opposite to said second direction.

3. A retaining member according to claim 1 wherein said retaining member includes a cavity for receiving at least part of said article.

4. A retaining member according to claim 1 wherein said body member is substantially cylindrical.

5. A retaining member according to claim 1 wherein said body member includes non-parallel upper and lower surfaces.

6. A retaining member according to claim 1 wherein said engagement member is biased towards said engaged position.

7. A retaining member according to claim 1 wherein said engagement member includes a plurality of pin members.

8. A retaining member according to claim 1 wherein said locking mechanism includes at least one locking member movable radially relative to said central longitudinal axis of said body member between an inner position and an outer position, wherein said locking member, when at said inner position, is closer to said central longitudinal axis of said body member than when at said outer position, and wherein when said locking member is in said inner position, said locking mechanism is adapted to prevent disengagement of said article from said retaining member.

9. A retaining member according to claim 8 wherein said locking member is biased towards said outer position.

10. A retaining member according to claim 8 wherein said ring member includes at least one actuating device adapted to move said locking member between said outer position and said inner position.

11. A retaining member according to claim 10 wherein said ring member is rotatable in said first direction to move said actuating device to move said locking member from said outer position to said inner position.

12. A retaining member according to claim 10 wherein said ring member is rotatable in said second direction to allow said locking member to move from said inner position to said outer position.

13. A retaining member according to claim 10 wherein said actuating device includes at least one cam member protruding from an inner surface of said ring member.

14. A retaining member according to claim 10 wherein said locking member includes at least one pin member.

15. A retaining member according to claim 10 wherein said locking member includes a plurality of pin members.

16. A retaining member according to claim 15 wherein said actuating device includes a plurality of cam members each adapted to move a respective pin member of said locking member from said outer position to said inner position.

17. A retaining member according to claim 1 wherein said retaining member is securable to a support surface.

18. A retaining member according to claim 1 wherein said engagement member is part of an engagement mechanism.

* * * * *